United States Patent [19]

Chenest

[11] Patent Number: 4,840,507

[45] Date of Patent: Jun. 20, 1989

[54] PRINTER WITH PRINTING SHIELD

[75] Inventor: Gerard Chenest, Saint Paer, France

[73] Assignee: Unisys Corporation, Blue Bell, Pa.

[21] Appl. No.: 165,311

[22] Filed: Mar. 8, 1988

[30] Foreign Application Priority Data

Nov. 14, 1987 [GB] United Kingdom ..... 8726732

[51] Int. Cl.[4] ..... B41J 11/62

[52] U.S. Cl. ..... 400/713; 400/247; 400/320

[58] Field of Search ..... 400/247, 713, 204, 206, 400/248, 320

[56] References Cited

U.S. PATENT DOCUMENTS

| | | | |
|---|---|---|---|
| 1,929,449 | 10/1933 | Trego | 400/247 |
| 2,236,011 | 4/1941 | Smith | 400/247 X |
| 2,699,244 | 1/1955 | Markes | 400/247 X |
| 2,849,096 | 8/1958 | Markes | 400/247 X |
| 4,268,182 | 5/1981 | Mizutani et al. | 400/247 |
| 4,468,143 | 8/1984 | Volhe et al. | 400/248 |
| 4,479,731 | 10/1984 | Kawaguchi | 400/320 |
| 4,650,355 | 3/1987 | Cassiano et al. | 400/248 X |
| 4,710,047 | 12/1987 | Barough et al. | 400/248 X |

FOREIGN PATENT DOCUMENTS

| | | | |
|---|---|---|---|
| 72577 | 4/1986 | Japan | 400/248 |
| 80074 | 4/1987 | Japan | 400/248 |

*Primary Examiner*—Edgar S. Burr
*Assistant Examiner*—James R. McDaniel
*Attorney, Agent, or Firm*—Mark T. Starr; Kevin R. Peterson

[57] ABSTRACT

A printer is provided with a band 44 attached to the printhead 54 to move to-and-fro across the line of printing, and around rollers (98,110) allowing it to pass beneath a printing support bed 12 so that introduced documents and documents being printed are restrained from excessive separation from the printing support bed 12. The band 44 is supported in association with the printhead 54 by non-return cylinders 58,64 capable only of uni-directional rotation. Each cylinder 58,64 is provided with a rotary spring 76 which takes up any excess length developing in the band 44. Spring loaded rollers 98,110 at either end of the printing path support the band 44. Electrical indication is provided when one, the other or both of the cylinders 58,64 cease to take up excess length and when one, the other or both of the spring loaded rollers 98,110 also cease to take up excess length in the band 44. Operation of the printer is inhibited when any selected one or group of electrical signals indicates exhaustion of tension in the band 44. A signal is provided triggered by intermittent operation of an electrical detector with movement of the head indicating imminent shut-down of the printer or exhaustion of tension.

23 Claims, 8 Drawing Sheets

PRINTER WITH PRINTING SHIELD

The present invention relates to printers operative to leave a readable record upon a surface of a presented document where the printer comprises a printhead moved transversely to the direction of advancement of the document.

It is known to provide a printer wherein a printhead is moved along a printing path adjacent to the surface of a presented document or sheet of paper. The printhead is operated as it moves along the printing path to leave a readable record upon the document. The record may be visible or can be in various optically or magnetically coded machine readable forms. The document is advanced between successive lines of printing. Such machines include the common typewriter using a daisy-wheel or golfball mechanism. Other printers also fall into this class. Dot matrix printers are known using either a cylindrical platten as a printing support surface or using a flat printing bed.

The present invention is hereinafter described with reference to its use in a flat-bed dot matrix printer. It is to be appreciated that the invention is not restricted to such use and may be embodied in all forms of printer wherein a printhead moves transversely to an advancing document.

In all printers where a document is introduced beneath a transversely moving printhead there is a problem that the leading edge of the document may foul the printhead or some part associated therewith or otherwise not be presented in intimate engagement with the printing support surface. This has the consequence that the printhead will engage the intruding document as it moves along its printing path and will tear the document or, at the very least, fold the surface and thereby provide discontinuous printing. The document so torn or folded can jam and this becomes a serious matter especially when high volume continuous stationery is being used.

The present invention consists in a printer operative to move a printhead along a printing path to leave a readable record on a surface of a presented document maintained on a printing support surface and advanced in the course of presentation and printing; said printing being transverse to the direction of advancement of the document; said printer comprising; a moveable band, supported to pass at a predetermined distance from and parallel to said printing support surface and to pass beneath said printing support surface, said band being operative to accept a document between said band and said printing support surface and to prohibit any portion of the document to exceed said predetermined distance from said printing support surface; said band being coupled to move with said printhead as said printhead moves along said path; said band permitting said printhead to protrude there-through to print upon the document; and said printer comprising automatic tensioning means operative to maintain tension in said band.

Excess length in the band is caused by slow extension of the band during its useful lifetime and must be accommodated to maintain tension in the band. The purpose of the band is to urge the leading edge of a document beneath the printhead no matter whether the leading edge is crumpled, folded or otherwise curved out of the plane and level of the printing support bed 12. If adequate tension is not maintained in the band the leading edge of a document becomes capable of moving the band aside to become enmeshed with parts of the printing mechanism with which no contact by the document was intended.

In order to maintain tension in the band the present invention further provides that the band comprises first and second ends attached to the printhead and a first non-return cylinder operative to accept said first end wrapped there-around and operative to resist unwrapping of the first end of the band. The non-return nature of the first non-return cylinder means that it will only wind uni-directionally. Winding of the first cylinder thereby creates and then maintains tension in the band.

In order automatically to establish a predetermined level of tension on the band the present invention further provides that the first non-return cylinder be provided with a first rotary spring operative to take up any slack in the band by rotating the first non-return cylinder and establishing in the band a predetermined level of tension. The present invention yet further provides that the second end of the band be attached to a second non-return cylinder which can comprise a corresponding second rotary spring.

In one preferred form of the invention the first and second rotary springs seek to cause predetermined tensions in the band as the respective non-return cylinders rotate the predetermined tensions having a range in each instance which does not overlap. That is to say, the first non-return spring seeks to create in the band a range of tensions which are everywhere greater than those tensions created by the second non-return spring. Each non-return cylinder has a limit of rotation. Whenever the first non-return cylinder has reached its limit of rotation with the second non-return cylinder being totally immobile, the second non-return cylinder commences and continues to take up any excess length in the band. This way the first and second non-return cylinders take it in turn to accommodate excess length in the band.

In a second preferred embodiment of the invention it is further provided that the ranges of tensions sought to be created by the first and second rotary springs overlap. In this manner one of the non-return cylinders takes up some of the excess length in the band until the torque in its rotary spring diminishes and becomes less than the torque in the other rotary spring in which case the other rotary spring commences to take up excess length. Thus the two rotary springs take up excess length one after the other or together.

Each of the non-return cylinders is preferably provided with means capable of providing indication when it has reached its limit of rotation which indication can be visual by way of marks on the cylinder and/or electrical by means of operation of switches or photo sensors or the like.

The present invention provides that the band is supported above and below the printing support surface by spring loaded support rollers which are again operative to maintain tension in the band. In one embodiment the spring loaded support rollers are designed to supply less tension in the band than are the non-return cylinders. Each end of the band is supported by its own spring loaded support rollers which again have different spring loadings to create different tensions in the band. As the spring loaded support rollers take up excess length in the band so they move and, when the movement has reached a limit, provide indication that their excess length accommodating role has finished.

When the non-return cylinder or cylinders have exhausted their capacity to take up excess length in the band the spring-loaded support rollers take over. First one spring loaded support roller uses up all of its capacity and then the other spring loaded support roller continues in accommodating excess-length in the band.

As the band stretches as its useful lifetime becomes exhausted so the first rotary cylinder, the second rotary cylinder or the spring loaded support rollers each provide indication that the band has stretched beyond respective predetermined limits and the indication can be used to halt operation of the printer at any one of these predetermined limits in order that the printer should not continue to function with a non-tensioned band or a band whose tension is below acceptable limits.

For preference the first and second ends of the band are attached respectively to the first and second cylinders by means of an adhesive tab which for preference consists in a small amount of adhesive spread on one surface of the first end of the band and of the second end of the band. The band for preference is transparent so that the action of the printhead in leaving a visible record upon the paper can be viewed as it progresses.

The present invention is further explained, by way of example, by the following description read in conjunction with the appended drawings in which:

FIG. 1 shows a projected view of a flat bed dot matrix printer (minus cover and printing mechanism) wherein the preferred embodiment of the present invention is to be described.

Figure 1:
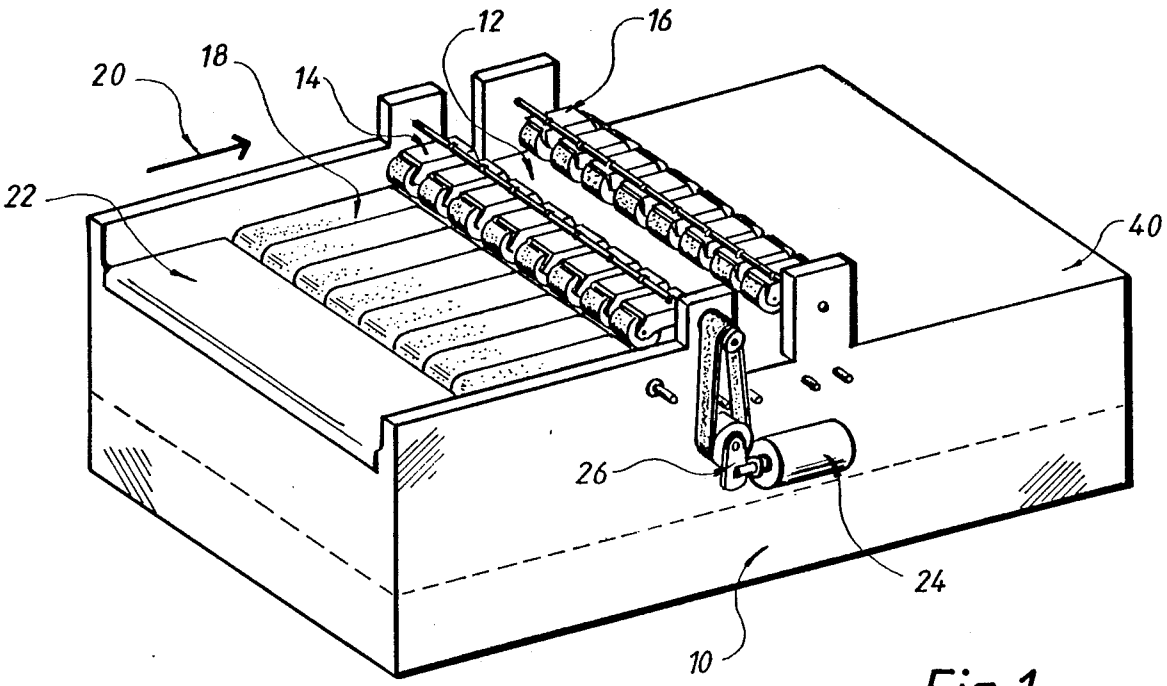
FIG. 1 is a projected view of a flat bed dot matrix printer of the type wherein the present invention is embodied.

A printer 10 comprises a flat printing bed 12 between first document drive rollers 14 and second document drive rollers 16. A document conveyor belt 18 conducts a presented document or sheet of paper as indicated by the arrow 20 from an apron 22 towards the flat printing bed 12. The first document drive rollers 14 are caused, by operation of a solenoid 24 operating through a crank arm 26, to engage a document. The second document drive rollers 16 are provided with a similar solenoid (not shown) which is selectably operable to cause the second document drive rollers 16 to engage a presented document or sheet of paper.

Figure 2:
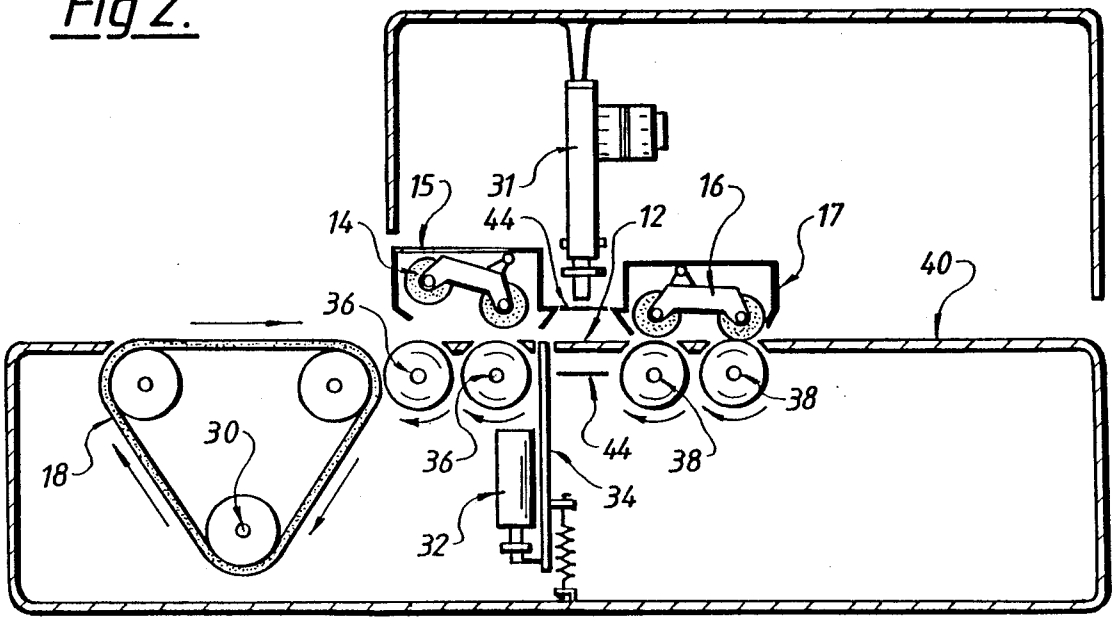
FIG. 2 is a cross sectional view taken along the line XX' of FIG. 1 looking in the direction of the arrows, this time with the cover (not shown in FIG. 1) in position.

FIG. 2 shows a cross sectional view of the printer on FIG. 1 this time with the cover of the printer in place.

The cover 28 holds a print mechanism housing 30 which, as will later be described, provides a dot matrix printhead movable in a path between the first document drive rollers 14 and second document drive rollers 16 along the flat printing bed 12. The first drive rollers 14 are supported and maintained within a fore-housing 15. The second drive rollers 16 are supported and maintained within an aft-housing 17. Both the fore-housing 15 and the aft-housing 17 are shaped to facilitate passage of a document there-beneath into the rollers 14,16. The conveyor 18 is moved by means of a driven pulley 30. A barrier solenoid 32 is selectably operable to raise a barrier 34 into the path of a presented document. The first and second document drive rollers 14,16 co-operative respectively with first document drive wheels 36 and second document drive wheels 38 to move a presented document or sheet of paper through the printer. Once printed a document is moved across an exit apron 40 to be delivered through an exit slot 42.

Included in the printer is a band 44 supported over the flat printing bed 12.

Figure 3:
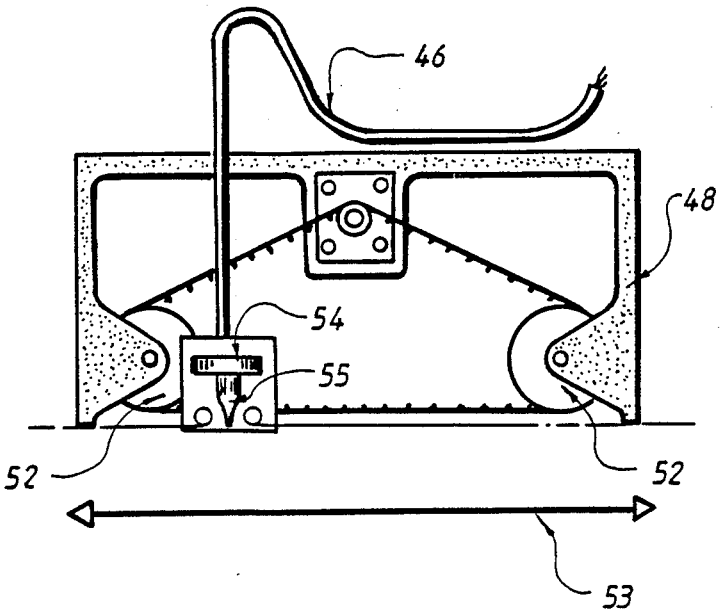
FIG. 3 shows the contents of the print mechanism housing of FIG. 2.

FIG. 3 shows the contents of the print mechanism housing 31.

A controlled stepping motor 46 in a frame 48 moves a toothed belt 50 around pulleys 52 to precisely position a dot matrix printhead 54 along a printing path 56. When a document is introduced onto the flat printing bed 12 the dot matrix printhead 54 is moved to and fro as indicated by the arrow 53 across the document to produce lines of printing and the document is advanced between each line of printing. The printhead 54 is supported in asssociation with a support plate 55 which serves to provide support for the band 44.

In operation a document is placed on an apron 22, the barrier 34 is raised and neither the first document drive rollers 14 nor the second document drive rollers 16 are engaged.

The conveyor belt 18 is then activated for a predetermined period which brings the leading edge of the document into engagement with the raised barrier 34. The conveyor belt 18 slides beneath the under surface of the document and the document rotates to align its leading edge with the raised barrier 34. Thereafter the conveyor belt 18 is de-energised, the first document drive rollers 14 are lowered to engage the first document drive wheels 36, the barrier 34 is lowered and the document is advanced by energising the first document drive wheels 36 beneath the print mechanism 31. Printing then commences. As the document enters there-beneath, the second document drive rollers 16 are also lowered into engagement with the second document drive wheels 38 and the first and second document drive wheels 36,38 activated in unison to move the document line-by-line beneath the print mechanism 31. When printing is complete the second document drive rollers 38 send the document out through the exit slot 42. Thereafter the first and second document drive rollers 14,16 are raised and the barrier 34 is raised ready to receive a new document.

Figure 4:
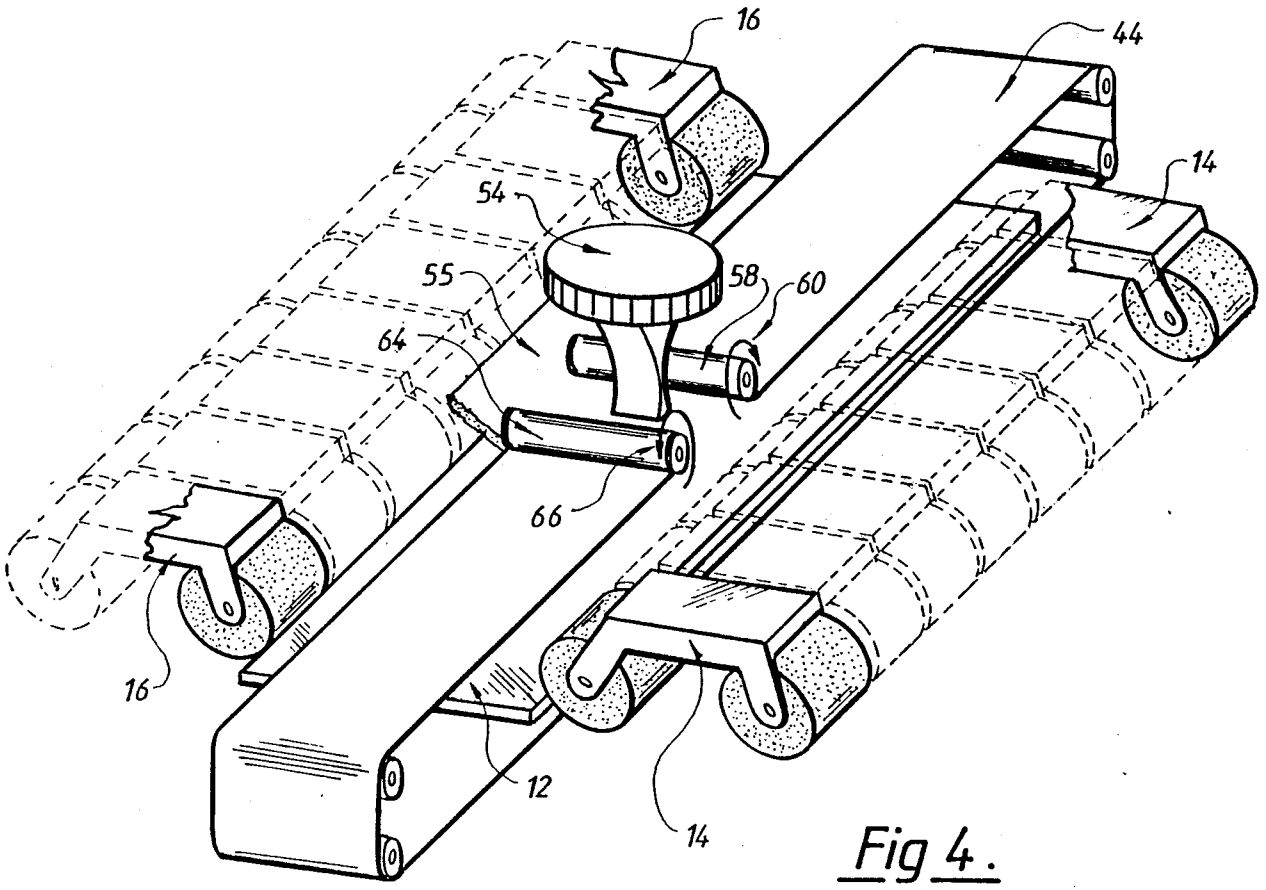
FIG. 4 shows a projected view of the dot matrix printhead with the band attached and supported along the printing path by spring-loaded rollers at either end.

FIG. 4 shows a projected view of the band 44 in association with the printhead 54 and the printing support bed 12.

The band 44 is held on the support plate 55 (here shown in partly broken-away form). A first end 56 of the band 44 is held on a first non-return cylinder 58. The first non-return cylinder 58 is held on a pin attached to the support plate 55 in a manner hereinafter described. The function of the first non-return cylinder 58 is to rotate as indicated by the arrow 60 to permit taking-up of excess length in the band 44 but to resist all rotation in a direction opposite to that shown by the arrow 60 so that excess length taken-up from the band 44 remains on the first non-return cylinder 58.

The second end 62 is held on a second non-return cylinder 64 which remains free to rotate as indicated by the arrow 66 to take up any excess length in the band 44 but which resists all rotation in a direction opposite to that indicated by the arrow 66 so that any excess length in the band 44 which has been taken up remains on the second non-return cylinder 64.

Figure 5:
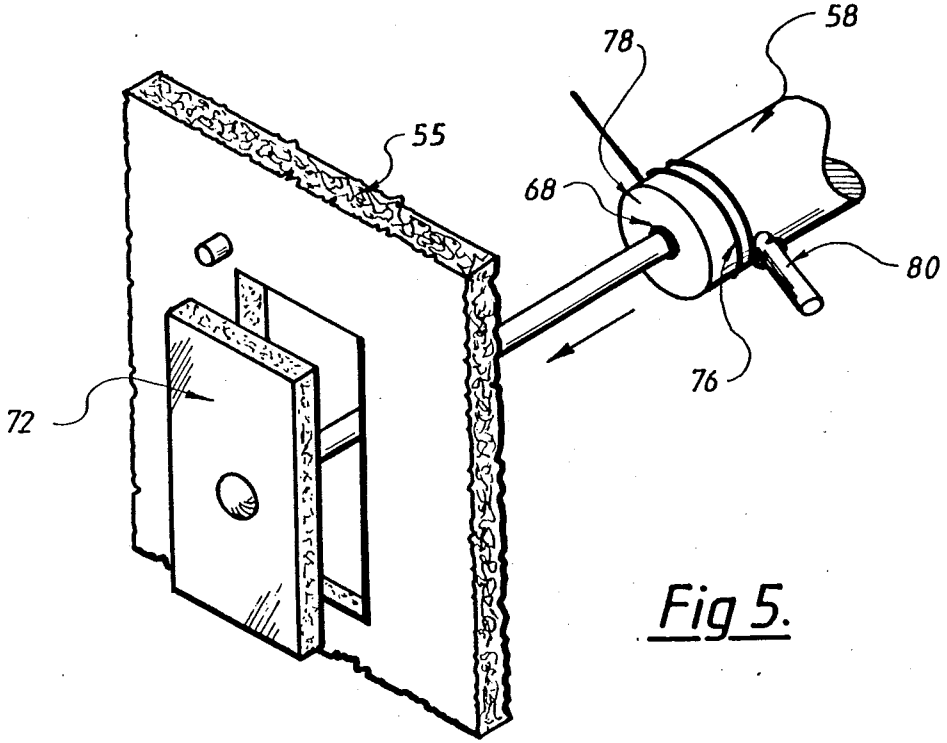
FIG. 5 shows assembly of a non-return cylinder over its support pin.

FIG. 5 shows a first stage in the attachment of the non-return cylinders 58,64 onto the support plate 55. While FIGS. 5 and 6 indicate that the non-return cylinder 58 is the first non-return cylinder, it is to be understood that it represents either of the non-returned cylinders 58,62 with the understanding that rotation of the non-return cylinder under spring restoration will be in opposite directions in each case as indicated by the arrows 60,66.

The non-cylinder 58 is hollow comprising a central bore 68 wherein a support pin 70 maintained on a tab 72 stamped and pushed back from the main surface of the support plate 55 is inserted. The aperture 74 in the support plate 55 wherefrom the tab 72 was partially cut is of sufficient dimensions to receive a rotary spring 76 wound around the basal end 78 of the non-return cylinder 58 and to receive a spring retaining pin 80 also proximate to the basal end 78 of the first non-return cylinder 58.

Figure 6:
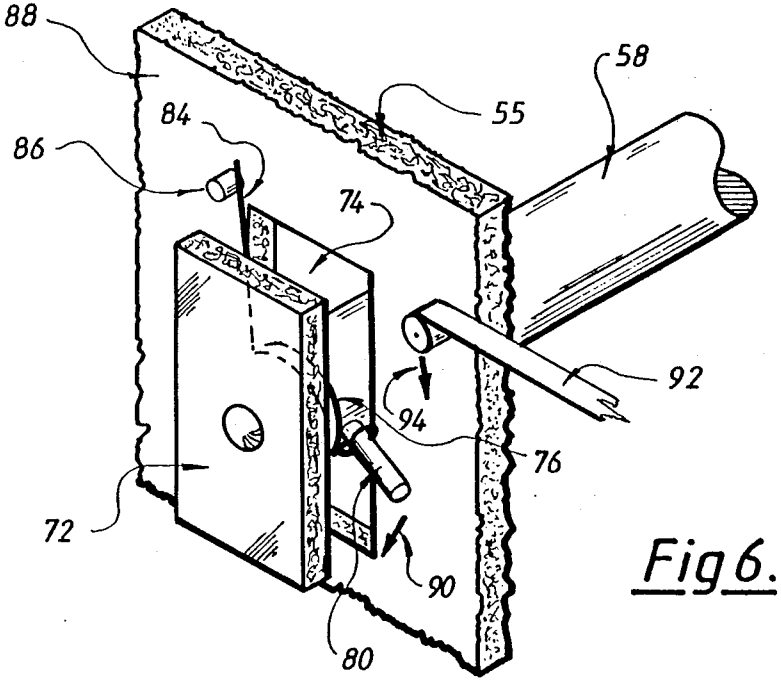
FIG. 6 shows an assembled non-return cylinder.

FIG. 6 shows the final stage of assembly of the non-return cylinders 58,64. The rotary spring 76 has a first end wrapped around the spring retaining pin 80 and a second free end 84 generally radially extensive from the first non-return cylinder 58 and operative to engage a boss 86 on the rear surface 88 of the support plate 55. The pin 80 and the second free end 84 of the rotary spring 76 pass through the aperture 74. The first non-return cylinder 58 with the first end 56 of the band 44 partially wrapped there-about is then rotated contrary to the arrow 90 to create torque in the rotary spring 76 which tends to rotate the first non-return cylinder 58 as indicated by the arrow 90. When the spring retaining pin 80 has executed most of a revolution it engages micro switch arm 92 which moves as indicated by the arrow 94 to provide indication, by operation of a micro switch (not shown), that the first non-return cylinder 58 has reached the limit of rotation. The micro switch arm 92 can also operate as a physical stop to the further rotation of the first non-return cylinder 58. The micro switch arm 92 is capable of free-movement contrary to the arrow 94 but is jammed against the body of the micro switch when urged in the direction of the arrow 94.

The manner in which the cylinders 58,64 are rendered uni-directional is by any means known to the skilled man. In the present instance the bore 68 comprises a uni-directional bearing (of a variety freely available on the market manufactured by the Torington Engineering Co.) wherein a set of spiral grooves similar in their disposition to rifling within a gun barrel are used to trap ball bearings. The grooves are of such a depth that, when the ball-bearing system rotates in a first direction the balls are urged into those portions of the grooves which are deeper and thus the bearing is free to rotate. Should the bearing be rotated in the opposite direction the balls are moved into those portions of the grooves which are more shallow and the balls seize and bind upon the support pin 70 preventing further rotation of the first non-return cylinder 58 upon the support pin 70. Thus only a very tiny movement in the reverse direction to that of taking up the band 44 is possible. In the present application the support pin 70 can be tapered so that the ball-jamming action does not commence until the first non-return cylinder 58 is fully on the support pin 70 thereby permitting tensioning of the rotary spring 76. As an alternative method the spring 76 can be tensioned by means of its free end 84 simply being wound once about the non-return cylinder 58 until it engages the boss 86.

In the present invention it is not important how the non-return function is achieved. The non-return feature may be provided with ratchet devices and other similar apparatus. The essential feature of the non-return device is simply that it is capable of exerting a movement opposing torque in excess of that capable of being supplied by the spring 76.

In a first variation of the preferred embodiment neither the first non-return cylinder 58 nor the second non-return cylinder 64 includes the rotary spring 76. Instead it is sufficient that the non-return capacity of the first 58 and second 64 non-return cylinders is exploited. When the printing apparatus is assembled and a band 44 is placed thereon the first 58 and second 64 non-return cylinders are simply rotated manually or by means of a tool such as a screwdriver to wind on sufficient of the band 44 so that no excess-length exists therein and adequate tension is established on the band 44.

It is also provided in a further variation in the present invention that one, the other or both the first 58 and second 64 non-return cylinders comprises a rotary spring system of the general type shown in FIGS. 5 and 6. While a specific form of helical spring has been shown in FIGS. 5 and 6 it is to be understood that the present invention can be implemented using any other form of elastic restoration to rotate the cylinders 58,64.

In the instance where only one of the cylinders 58,64 comprises a rotary spring 76 the cylinder 58,64 not possessing the rotary spring merely resists paying-out its respective end of the band 44 and any subsequent excess length in the band 44 due to stretching during use is taken up by rotation of the other cylinder 58,64 under action of the rotary spring 76.

As previously stated, the present invention also provides that both the first 58 and second 64 cylinders should comprise a restoring rotary spring 76 in which case the first non-return cylinder 58 is served by a first rotary spring 76 and the second non-return cylinder 64 is served by a second rotary spring (not specifically or separately shown in the drawings). In one version of the present invention the first rotary spring 76 is made very much stronger than the second rotary spring. This ensures that the range of tensions in the band 44 whereat the first rotary spring 76 and the second rotary spring are active respectively to draw excess band 44 on to the first 58 and second 64 non-return cylinders do not overlap. In this instance the first rotary spring 76 acts initially alone to take up excess length in the band 44. When the first non-return cylinder 58 can no longer rotate it ceases movement, the tension in the band 44 begins to drop and the second rotary spring takes over at a lower tension level to accommodate excess tension in the band 44.

In another version of the present invention it is provided that the first 76 and the second rotary springs are of about the same strength so that the range of tensions in the band 44 overlap whereat the first 76 and second rotary springs urge their respective non-return cylinders 58,64 to take up excess length in the band 44 overlap. Thus one of the cylinders 58,64 will take up some excess length in the band 44 until tension in the band 44 drops as the first 76 or second rotary spring partially unwinds. When tension in the band has dropped to a sufficiently low level the first 76 or second rotary spring (whichever is currently operative) ceases to rotate its respective cylinder 58,64 and the other rotary spring takes up the action of reeling-in-excess length of the band 44. This way the cylinders 58,64 repeatedly alternate to draw-in excess length in the band.

Not shown in the drawings but otherwise provided are visual indicating marks on the first 58 and second 64 non-return cylinders whereby, by inspection it can be ascertained whether or not the rotation capacity of the cylinder 58,64 has been exhausted. Should the mark be uppermost (or in any other predetermined position) the cylinder 58,64 can no longer rotate and the respective predetermined tension limit in the band 44 whereat rotation ceases has been passed. The Service Engineer or other operator can then take cogniscence of this fact in determining whether or not to replace the band 44.

Whereas a micro switch arm 92 has been shown for engaging the spring retaining pin 80 to provide electrical indication of exhaustion of take-up capacity of a cylinder 58,64 it is to be understood that photo optic devices and optical flag components on the basal end 78 of the non-return cylinder 58,64 can equally be used to indicate arrival at an extreme rotational position.

Figure 7:
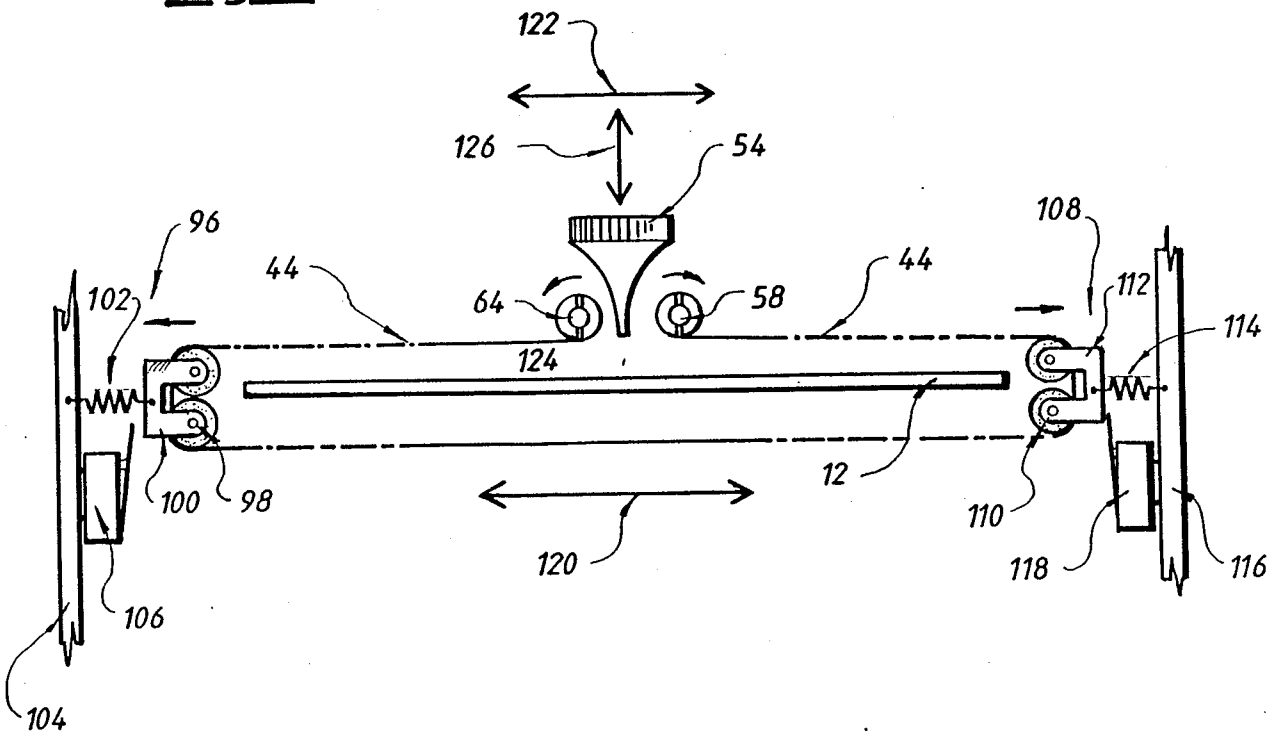
FIG. 7 shows a side elevation schematic view of the entire band taken along the line YY' of FIG. 4 looking in the direction of the arrows.

FIG. 7 shows an elevated view of the entire band 44 along the line YY' in FIG. 4 looking in the direction of the arrows.

The band 44 as well as being supported by a first non-return cylinder 58 and the second non-return cylinder 64 is also supported at a first extremity 96 of the printing path by a first set of support rollers 98 held on a first yoke 100 attached by a first restoration spring 102 to a first side 104 of the printer. The first support roller micro switch 106 detects when the first yoke 100 has moved closer than a predetermined distance from the first side 104 of the printer.

At a second extremity 108 of the printing path a second set of support rollers 110 supports the band 44 in its passage from being above and parallel to the flat printing bed 12 to passing beneath the flat printing bed 12. A second yoke 112 supports the second set 110 of rollers and a second restoration spring 114 pulls the second yoke 112 towards a second side 116 of the printer. A second support roller micro switch 118 detects when the second yoke 112 is closer than a predetermined distance from the second side 116 of the printer. As the printhead 54 is moved to and fro along the line of printing so the band 44 moves to and fro on the first and second support rollers 98,110 as indicated by the double arrow 120. It is to be understood that the first support roller micro switch 106 and the second support roller micro switch 118 can be replaced by an optical device or by any device capable of providing an electrical signal when the respective yokes 100,112 are respectively closer than their predetermined limits to their respective sides 104,116 of the printer.

In one version of the invention the first restoration spring 102 is made very much stronger than the second restoration spring 114. When no more excess length is being taken up by the cylinders 58,64 the first restoration spring 102 maintains tension in the band 44 at a lower limit than would be maintained by either of the cylinders 58,64. As the useful lifetime of the band 44 is used up and more excess length appears, so the first yoke 100 operates the first support roller micro switch 106 to provide electrical indication that yet another predetermined amount of extension has taken place in the band 44. Thereafter the second restoration spring 114 acts alone to maintain tension in the band 44.

At the stage where both of the cylinders 58,64 and the first restoration spring 102 have exhausted their capacity to maintain tension in the band, the band 44 is in imminent danger of becoming too slack for use. In order to avoid jamming or other catastrophic failure in the printer it is arranged that when the first support roller micro switch 106 provides indication of exhaustion of tensioning capacity in the first restoration spring 102 the printer is inhibited from further action. Thus the printer ceases printing while there is still just sufficient tension in the band 44 under the action of the second restoration spring 114 and before any catastrophic failure can occur.

The present invention also provides that operation of the printer should cease or provision of warning indication be given whenever the electrical signal indicative of the first cylinder 58 and/or the second cylinder 64 having exhausted their tensioning capacity is provided.

In another variation in the present invention it is provided that the first restoration spring 102 and the second restoration spring 114 are of about the same strength and that operation of the printer is inhibited whenever both the first support roller micro switch 106 and the second support roller micro switch 118 provide indication of exhaustion of tensioning capacity in their respective springs 102,114.

As the printhead 54 moves to and fro as indicated by the double arrow 122 so it provides differential pull to one side or the other due to friction in the support rollers 98,110. Thus, as the printhead 54 moves to the right as seen in FIG. 7 the first yoke 100 will be pulled slightly to the right and the second yoke 112 will be allowed to move slightly to the right also. As the printhead 54 moves to the left as seen in FIG. 7 so the first yoke 100 will move slightly to the left and the second yoke 112 will be pulled slightly to the left. Should either the first yoke 100 or the second yoke 112 be close to its limit of distance from its respective side 104,116 of the printer the respective micro switch 106,118 will intermittently be operated as the printhead 54 is moved. The present invention further provides that, should either the first support roller micro switch 106 or the second support roller micro switch 118 (as appropriate in the various embodiments) show intermittent operation during movement of the printhead, indication is provided of imminent closedown of the printer due to imminent over-stretching of the band 44.

Whereas the first restoration spring 102 and the second restoration spring 114 have here been shown as simple helical springs it is to be understood that any other spring or combination of springs capable of performing the above described function can be used in their place. Likewise the restoration springs 102,114 can be replaced by steel-wires running over pulleys to spring restored drums in the manner well known in the construction of typewriting machines and computer printers.

For clarity it is here stated that the printhead 54 comprises a tip 124 which, when the document is inserted into the printer, is at the same height or level as the bases or lower portions of the non-return cylinders 58,64. An optical sensor (not shown) moves with the printhead 54 across the document to sense its edges and any characters printed thereon. Thereafter the printhead 54 is lowered as indicated by the arrow 126 to contact the document lying on the printing bed 12 and to print on the document. After printing and before withdrawal of the document the printhead 54 is once again withdrawn to the position shown in FIG. 7 and as indicated by the double arrow 126.

Figure 8:
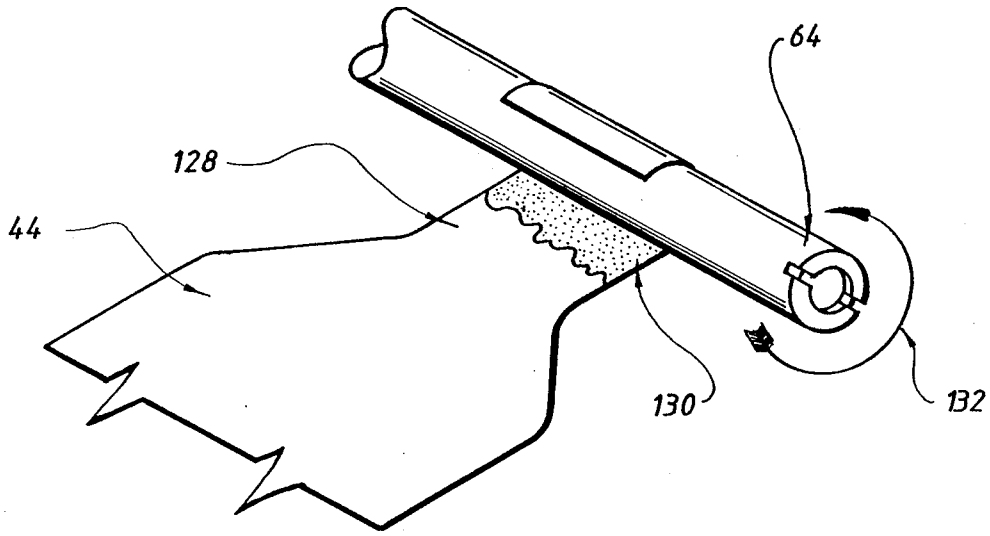
FIG. 8 shows how the band is attached to the non-return cylinders.

FIG. 8 shows how the band 44 is attached for preference to the cylinder 64. It is to be understood that FIG. 8 is equally representative of the band 44 being attached to the first non-return cylinder 58. A neck portion 128 of the band has adhesive 130 spread on one surface thereof. The adhesive 130 is allowed to dry and the band 44 stored for future use. When the band 44 has to be placed into the printer the adhesive 130 is placed in contact with the cylinder 64 which is rotated as indicated by the arrow 132 to wind most of the excess band 44 onto the cylinder 64. The cylinder is then put in place as generally illustrated in FIGS. 5 and 6.

I claim:

1. A printer operative to move a printhead along a printing path to leave a readable record on a surface of a presented document maintained on a printing support surface and advanced in the course of presentation and printing; said printing being transverse to the direction of advancement of the document; said printer comprising; a moveable band, supported to pass at a predetermined distance from and parallel to said printing support surface and to pass beneath said printing support surface, said band being operative to accept a document between said band and said printing support surface and to prohibit any portion of the document to exceed said predetermined distance from said printing support surface; said band being coupled to move with said printhead as said printhead moves along said path; said band permitting said printhead to protrude there-through to print upon the document; and said printer comprising automatic tensioning means operative to maintain tension in said band.

2. A printer according to claim 1 wherein said band comprises first and second ends attached to said printhead and wherein said tensioning means comprises a first non-return cylinder operative to accept said first end wrapped there-around and operative to resist unwrapping of said first end.

3. A printer according to claim 2 comprising a first rotary spring operative to urge said first non-return cylinder to rotate to wrap said first end onto said first non-return cylinder.

4. A printer according to claim 2 wherein said tensioning means comprises a second non-return cylinder operative to receive said second end wrapped there-around and operative to resist unwrapping of said second end.

5. A printer according to claim 4 comprising a second rotary spring operative to urge said second non-return cylinder to rotate to wrap said second end onto said second non-return cylinder.

6. A printer according to claim 5 wherein the range of tensions within which said first and second rotary springs, cause respectively said first and second non-return cylinders to take up respectively said first and second ends of said band, do not overlap, for one of said cylinders firstly to take up excess length in said band until its capacity to take up said band is exhausted, and thereafter for the other of said cylinders to commence and continue to take up excess length in said band.

7. A printer according to claim 5 wherein the range of tensions within which said first and second rotary springs, cause respectively said first and second non-return cylinders to take up respectively said first and second ends of said band, overlap, for each of said cylinders repeatedly and in turn to take up excess length in said band.

8. A printer according to claim 2 wherein said first non-return cylinder comprises means operative to provide indication when said first rotary spring has reached a limit of being capable further to urge said first non-return cylinder to rotate.

9. A printer according to claim 4 wherein said second non-return cylinder comprises means operative to provide indication when said second rotary spring has reached a limit of being capable further to urge said second non-return cylinder to rotate.

10. A printer according to claim 1, including spring-loaded support rollers operative to maintain tension in said band and operative to support said band in its passage from parallel adjacence to said printing support surface beneath said printing support surface.

11. A printer according to claim 10 wherein said spring-loaded support rollers are operative to maintain tension in said band when said first cylinder has exhausted its capacity to wrap said first end there-around.

12. A printer according to claim 10 including spring-loaded support rollers operative to maintain tension in said band and operative to support said band in its passage from parallel adjacence to said printing support surface to being beneath said printing support surface.

13. A printer according to claim 12 wherein said spring-loaded support rollers are operative to maintain tension in said band when both said first and second cylinders have each exhausted their respective capacities to wrap respectively said first and second ends onto themselves.

14. A printer according to claim 10 wherein said spring loaded support rollers comprise first and second support roller sets, one at either end of said printing path, and wherein said first support roller set is operative to maintain tension in said band after take-up of excess length in said band has caused said second roller set to exhaust its capacity to take up further excess length; said printer including means operative to detect and provide indication of said second roller set having exhausted said capacity.

15. A printer according to claim 14 wherein said indication of said means operative to detect exhaustion of capacity of said second roller set is operative to cause cessation of further operation of said printer.

16. A printer according to claim 8 wherein said indication of said first rotary-spring having reached said limit is operative to cause cessation of further operation of said printer.

17. A printer according to claim 9 wherein said indication of said second rotary spring having reached said limit is operative to cause cessation of further operation of said printer.

18. A printer according to claim 2 wherein said first end is attached to said first cylinder by a first adhesive tab.

19. A printer according to claim 18 wherein said first adhesive tab consists in adhesive applied to a surface of said first end.

20. A printer according to claim 4 wherein said second end is attached to said second cylinder by a second adhesive pad.

21. A printer according to claim 20 wherein said second adhesive pad consists in adhesive applied to a surface of said second end.

22. A printer according to claim 1 wherein said band is transparent.

23. A printer according to claim 14, wherein indication is provided of imminent exhaustion in response to intermittent indication being provided by said means operative to detect exhaustion of capacity in said first or second rollers sets.

* * * * *